US007716876B2

(12) United States Patent
Wiegand et al.

(10) Patent No.: US 7,716,876 B2
(45) Date of Patent: May 18, 2010

(54) CATAPULT AIR BEAM WITH PERMANENTLY AFFIXED LACELOOPS

(75) Inventors: Joseph G. Wiegand, Conklin, NY (US); James G. Reyen, Binghamton, NY (US)

(73) Assignee: Johnson Outdoors Inc., Racine, WI (US)

( * ) Notice: Subject to any disclaimer, the term of this patent is extended or adjusted under 35 U.S.C. 154(b) by 216 days.

(21) Appl. No.: 11/750,656

(22) Filed: May 18, 2007

(65) Prior Publication Data

US 2007/0271854 A1 Nov. 29, 2007

Related U.S. Application Data

(60) Provisional application No. 60/801,921, filed on May 19, 2006.

(51) Int. Cl.
*E04G 11/04* (2006.01)
*E04H 15/20* (2006.01)
*E04B 1/34* (2006.01)

(52) U.S. Cl. ..... 52/2.11; 52/2.14; 52/2.18; 52/2.21; 52/2.22; 52/2.25; 52/2.26

(58) Field of Classification Search ..... 52/2.11, 52/2.14, 2.18, 2.21, 2.25, 2.26, 63, 86
See application file for complete search history.

(56) References Cited

U.S. PATENT DOCUMENTS 1,660,378 A * 2/1928 Dieterle ..... 473/597
1,857,482 A * 5/1932 Sonnett ..... 473/599
2,854,014 A * 9/1958 Hasselquist ..... 52/2.19
3,071,133 A * 1/1963 Eisen ..... 602/13
4,003,098 A * 1/1977 Fink ..... 5/93.1
4,959,901 A * 10/1990 Parish ..... 52/2.18
5,269,623 A * 12/1993 Hanson ..... 404/6
5,555,679 A * 9/1996 Scherba ..... 52/2.18
5,570,544 A * 11/1996 Hale et al. ..... 52/2.18
5,987,822 A * 11/1999 McNiff et al. ..... 52/2.11
6,008,938 A * 12/1999 Suehle et al. ..... 359/443
6,070,366 A * 6/2000 Pierson ..... 52/2.17
6,463,699 B1 * 10/2002 Bailey et al. ..... 52/2.11
6,929,016 B2 * 8/2005 Lee ..... 135/126
7,160,214 B1 * 1/2007 Rome ..... 473/454
7,181,877 B2 * 2/2007 Quade ..... 40/610
D543,229 S * 5/2007 Hochendoner ..... D16/241
7,446,937 B2 * 11/2008 Poretskin ..... 359/443
7,509,774 B1 * 3/2009 Johnson et al. ..... 52/2.11
D593,591 S * 6/2009 Hochendoner et al. ..... D16/241
2002/0023390 A1 * 2/2002 Nagle ..... 52/2.18
2005/0126082 A1 * 6/2005 Boschma et al. ..... 52/2.11
2005/0224545 A1 * 10/2005 Boschma, Jr. ..... 224/403
2005/0246964 A1 * 11/2005 Graham ..... 52/2.11

* cited by examiner

*Primary Examiner*—Richard E Chilcot, Jr.
*Assistant Examiner*—Mark R Wendell
(74) *Attorney, Agent, or Firm*—Reinhart Boerner Van Deuren P.C.

(57) ABSTRACT

An inflatable air beam having a laceloop assembly affixed thereto, a structure utilizing same and a method of constructing a structure is provided. In the structure, the fabric is laced to a structural support, typically, an air beam to position and properly tension the fabric thereon. The laceloop assembly includes spaced apart adjacent laceloops that are interconnected to secure the fabric panel to the structural support. In practicing the method, the laceloops are passed through fabric panels and through adjacent laceloops to interconnect the adjacent laceloops and secure the fabric panels to the structural support.

22 Claims, 7 Drawing Sheets

CATAPULT AIR BEAM WITH PERMANENTLY AFFIXED LACELOOPS

CROSS-REFERENCE TO RELATED PATENT APPLICATION

This patent application claims the benefit of U.S. Provisional Patent Application No. 60/801,921, filed May 19, 2006, the teachings and disclosure of which are hereby incorporated in their entireties by reference thereto.

FIELD OF THE INVENTION

This invention generally relates to air supported structures; and more particularly to air beams or air tubes for supporting tents and other structures.

BACKGROUND OF THE INVENTION

An inflatable tubular beam, also known as an air beam or air tube, is a structural support element having a pre-shaped structure, e.g., a cylindrical tube, of flexible material which is inflated to develop its rigidity. Air beams are particularly useful in situations where light weight and/or compact storage capability of the uninflated element are desired.

Inflated air beams can take various shapes and forms. Arched air beams are used, inter alia, in rapidly deployable shelters. Due to the light weight and compactness of the inflatable beams, such shelters are more conveniently transported, more quickly erected, and require less labor than conventional rigid structures.

It is known in the prior art to produce an inflatable curved or arched tubular beam or air beam by providing a gas-impermeable elastomeric or polymer film tubular lining or air bladder inside a fiber reinforced outer sleeve, such as a braided sleeve. When used in a tent or other structure, the tent fabric is positioned over these air beams to form the interior space of the tent or structure.

As with tents that use rigid support members, it is important to tension the tent fabric on the supports to prevent or reduce ponding (the collection of water on the fabric), excessive flutter of the fabric during windy conditions, etc. Unfortunately, unlike when rigid support structures are used, problems in getting the tent fabric to stay aligned on the air beams and maintaining proper tension exist. Current methods to tension the fabric on the air beam structures requires the user to pull the fabric from each end. However, because users typically only put tension on the fabric by pulling along the lace lines, where adjacent panels of material are laced together, this method is problematic and does not adequately secure the fabric to the air beam.

Current assembly methods require laying separate fabric panels between the air beams, pulling two panels of tent fabric together over one beam and lacing the two panels together. As the two panels are being laced together, the joined panels are buckled to the air beam using web and buckles attached to both the fabric sections and beams. As discussed previously, the present inventors have identified this method of assembly to be problematic as it prevents properly tensioning the tent fabric and aligning the tent fabric relative to the air beams.

In view of the above, there exists a need in the art for an improved structural support for supporting fabric panels for forming structures that enables improved positioning and/or tensioning of the tent fabric that overcomes the problems existing in the art. The apparatus and method of the present invention provides such a structural support and method of securing fabric panels to the structural support.

BRIEF SUMMARY OF THE INVENTION

Embodiments of the invention provide an apparatus and method for improving the attachment of a fabric panel of a structure to the support structure, and to structures incorporating same.

The invention is applicable to structures such as tents and shelters that use fabric panels to provide an interior area that provides shelter from the exterior elements. In one embodiment, the invention provides an air beam that is a structural support for the structure that includes an improved structure for attaching fabric panels thereto. More particularly, the air beam includes a plurality of fasteners positioned along the length of air beam to secure the fabric panels to the air beam. With the fasteners positioned along the length of the air beam, the fabric panels may be secured in numerous positions along the length of the air beam rather than merely proximate the edges of the fabric panels. In one preferred embodiment, the fasteners are in the form of laceloops that may be laced together to attach the fabric panel(s) to the air beam more in a more accurate and consistent location, because of the numerous positions along the length of the air beam. In a more preferred embodiment, the laceloops are secured to a base material, preferably a webbing, and the base material is affixed to the air beam. The air beam may include an outer sleeve that surrounds an inner bladder, and the base material may affixed to the outer sleeve.

In a further embodiment of the present invention, a structure utilizing laceloops to secure at least one fabric panel to a structural support is provided. The structural support could include an air beam or a rigid structural support such as a metal structural support. In a preferred embodiment, the structure includes an anchor for securing the laceloops in a laced condition, preventing the laceloops from unlacing. In a preferred embodiment, after all of the laceloops are interlaced, the last laceloop is anchored by working it back up the lace line and tied using a slip knot to prevent the lace line of interlaced laceloops from unlacing. In a further preferred form of the invention, the last laceloop in a lace line may be longer than the other laceloops to facilitate working the loop back up the lace line and tie it to prevent unlacing.

A preferred method according to the teachings of the present invention provides interlacing a plurality of the laceloops to secure a fabric panel or a plurality of fabric panels to the structural support. The method includes passing adjacent laceloops of the structural support through an aperture in one or more fabric panels and then connecting the adjacent laceloops together. It is preferred that only a single laceloop passes through any given laceloop. Additionally, in one method, the plurality of laceloops are separated at the peak of the structure and laced into separate portions of laceloops. In one method, the laceloops in these separate groupings are laced in a direction extending from the peak of the structure toward the sides of the structure. Once the groupings of laceloops are laced together, the last laceloop in the string of laced laceloops is anchored to prevent the laces from unlacing. The laces may be anchored by tying the last laceloop back on itself, the lace line, a stake, or otherwise securing it to prevent unlacing of the lace line. In an alternative method, the groupings of laceloops are laced toward each other, and the center of the tent, and the last laceloops in the individual groupings are tied to each other to prevent the groupings from unlacing.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF EMBODIMENTS OF THE INVENTION

Figure 1:
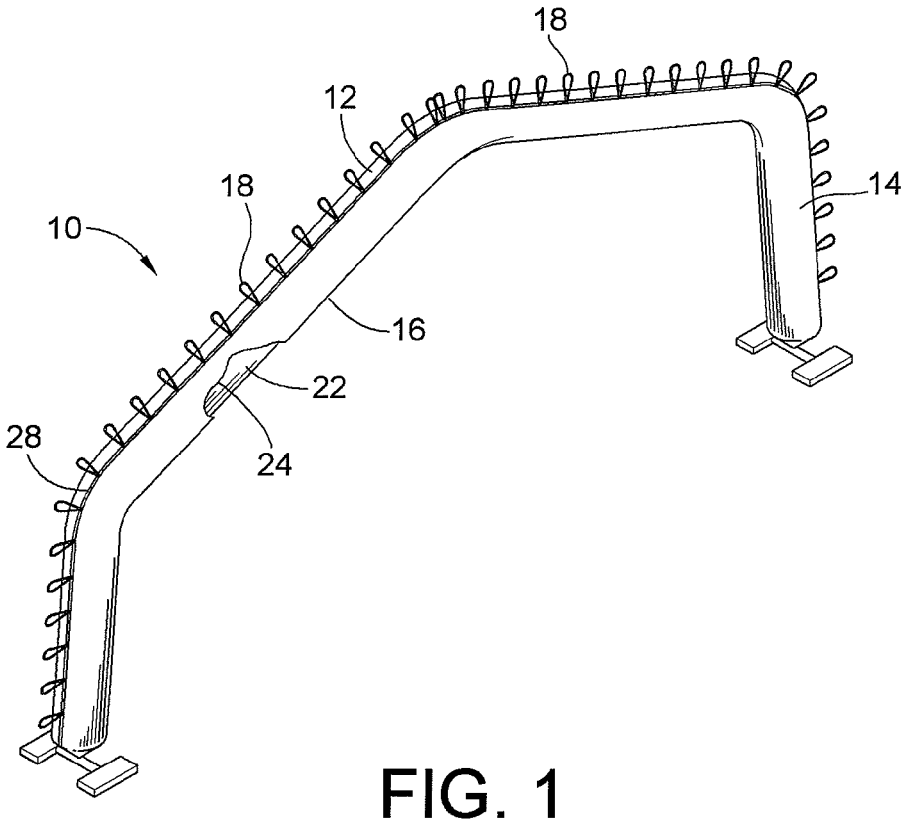
FIG. 1 is an isometric view of one embodiment of an air beam constructed in accordance with the teachings of the present invention.
Figure 2:
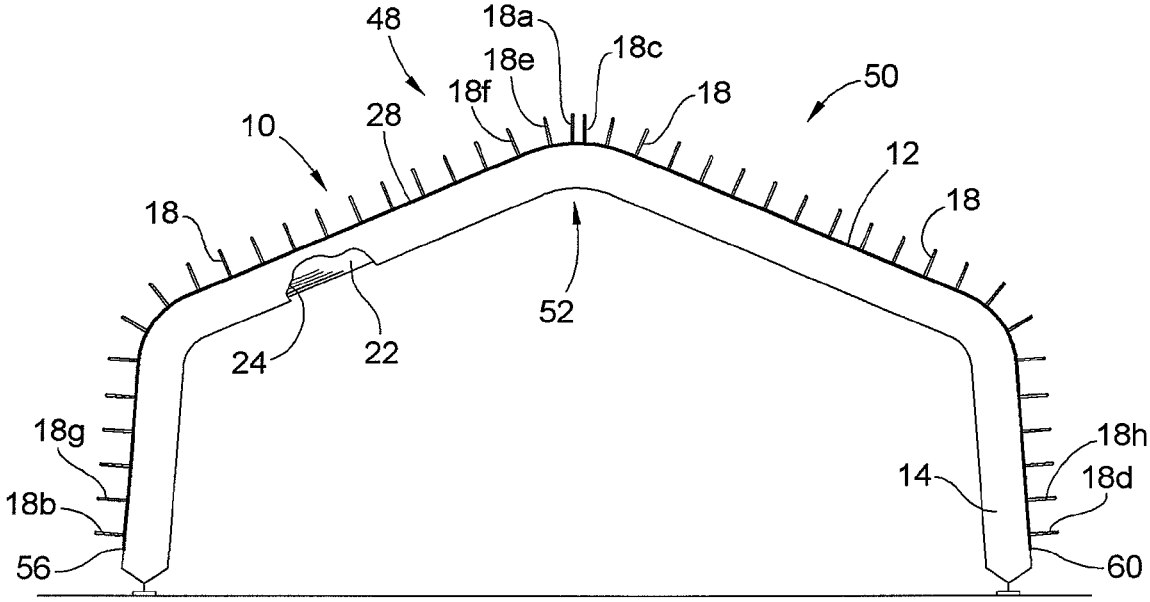
FIG. 2 is a front view of the embodiment of FIG. 1.

FIGS. 1 and 2 illustrate an air beam 14 for use as a structural support for a structure such as, for example, a tent or shelter. The air beam 14 includes improved attachment fastening structure, illustrated in FIGS. 1 and 2 as a laceloop assembly 10, for attaching fabric panels 20, 21 (see FIGS. 6-9) to the air beam 14 to construct the structure. In the illustrated embodiment, a single laceloop assembly 10 is affixed to the top surface 12 of the air beam 14. However, it is contemplated that the laceloop assembly could be secured at other locations around the air beam including the bottom surface 16 or the sides of the air beam 14 depending on the application and position of the air beam 14 with in the tent structure. The laceloop assembly 10 extends a substantial length of the air-beam 14. The laceloop assembly 10 provides a plurality of fasteners in the form of laceloops 18 (identified generically when using reference numeral 18 and specifically as 18*a*, 18*b*, 18*c*, etc, as in FIG. 2) forming a string of laceloops 18 along the length of the air beam 14. The string of laceloops 18, i.e. fasteners, may include more than 10 fasteners spaced along the length of the air beam 14 to secure and position the fabric panels 20, 21 along the length of the air beam 14. This configuration more accurately positions the fabric panels 20, 21 relative to the air beam 14 as well as more evenly distributes any loading such as up loading from drafts or loading from snow or wind on the fabric panels across the area of the panels 20, 21.

The typical air beam 14 includes an inner bladder 22 that is typically formed from a gas-impermeable elastomeric or polymer material. The inner bladder 22 is inflated with compressed gas, typically air, to give the air beam 14 rigidity. Surrounding the inner bladder 22 is an outer sleeve 24. The outer sleeve 24 may be fiber reinforced, such as a braided sleeve or other fabric material. The outer sleeve 24 protects the inner bladder 22 and adds further rigidity and support to the air beam 14. Additionally, in an embodiment, the outer sleeve 24 provides a medium to which the laceloop assembly 10 may be attached using attachment methods further described below.

Figure 3:
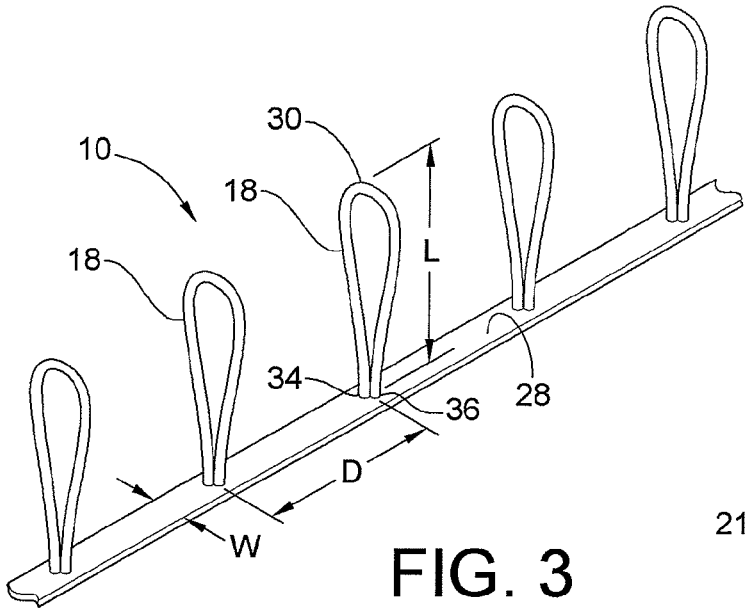
FIG. 3 is a perspective view of an embodiment of a laceloop assembly according to one embodiment of the present invention.

FIG. 3 illustrates a section of an embodiment of a laceloop assembly 10 incorporating one embodiment of laceloop 18. The illustrated embodiment of the laceloop assembly 10 is formed from a plurality of laceloops 18 attached to a webbing 28, which acts as a base material. Opposed end portions 34, 36 of individual laceloops 18 are secured to the webbing 28 to provide a continuous loop. Typically, the end portions 34, 36 of the laceloops 18 are stitched to the webbing 28. Alternative embodiments use a single length of lacing that forms all of the laceloops 18 attached to a piece of webbing 28. In this embodiment, the length of lace is gathered to form a loop and then intermittently affixed to the webbing 28 to form the adjacent laceloops 18.

However, the laceloops 18 could be otherwise secured to the webbing 28 such as being interwoven into the webbing 28, adhesively bonded to the webbing 28, tied to the webbing 28, etc. The loop formed by each laceloop 18 is used to interlace adjacent laceloops 18 by receiving an adjacent laceloop 18 therethrough to form a lace line as will be more fully described below. Whether the laceloops are formed by individual pieces of lacing or a single length of lacing that is bunched, embodiments of the laceloop assemblies have adjacent laceloops 18 spaced apart a distance D. In the illustrated embodiment, the distance D is approximately the length L of a laceloop 18 from its free end 30 to the location at which the laceloop 18 is secured to webbing 28, i.e. opposed ends 34, 36, to facilitate lacing adjacent laceloops 18. Preferably, but not necessarily, the distance D between adjacent laceloops 18 is greater than the length L of a taught laceloop 18. By having the length L of the laceloops 18 greater than distance D between the laceloops 18, some slack is available to interweave adjacent laceloops 18 during lacing.

Figure 4:
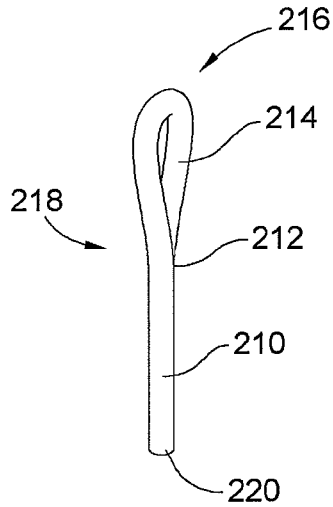
FIG. 4 illustrates a side view of an alternative laceloop for use in the laceloop assembly of FIG. 4.

The laceloops 18 are preferably made from lacing formed by tubular webbing. However other materials such as rope may be used as lacing. Additionally, the laceloops 18 may be in the form of cords, straps, etc. The laceloop need not form a loop by attaching two ends of a piece of elongated material to the webbing 28. Alternatively, as illustrated in FIG. 4, an alternative laceloop 218 may be formed from a single piece of material 210 folded back onto itself and secured thereto, such as at seam 212. This configuration forms a loop 214 proximate end 216 of the piece material. The opposite end 220 may be used to secure the laceloop 218 to a webbing 28, directly to the air beam 14 or to the outer sleeve 24.

Returning to FIG. 3, a preferred webbing 28 has a width W that is approximately two inches (2") wide and is formed from 12,000 lbs webbing. Preferably, the laceloops 18 are centered relative to the width W of the webbing 28. The webbing 28 may be formed from natural or synthetic materials and is preferably made from woven polyester.

The webbing 28 may be stitched (as illustrated by stitches 29 in FIG. 6), adhesively bonded, interwoven, laced, chemically bonded or otherwise affixed to the air beam 14. Alternatively, the webbing could be formed as a sleeve or jacket that surrounds or otherwise wraps around the air beam 14. However, the webbing 28 is typically a strip of webbing 28 that is affixed to the outer sleeve 24 of the air beam 14 by chemically bonding the webbing 28 to the outer sleeve 24.

As such, the preferred air beam 14 utilizes a laceloop assembly 10 in which the laceloops 18 attach to webbing 28 and the webbing 28 is used to indirectly mount the laceloops 18 to the outer sleeve 24 of the air beam 14. However, embodiments of the air beam 14 could have the laceloops 18 secured directly to the sleeve 24 or inner bladder 22 without using the intermediate webbing 28 as a base material.

Figure 5:
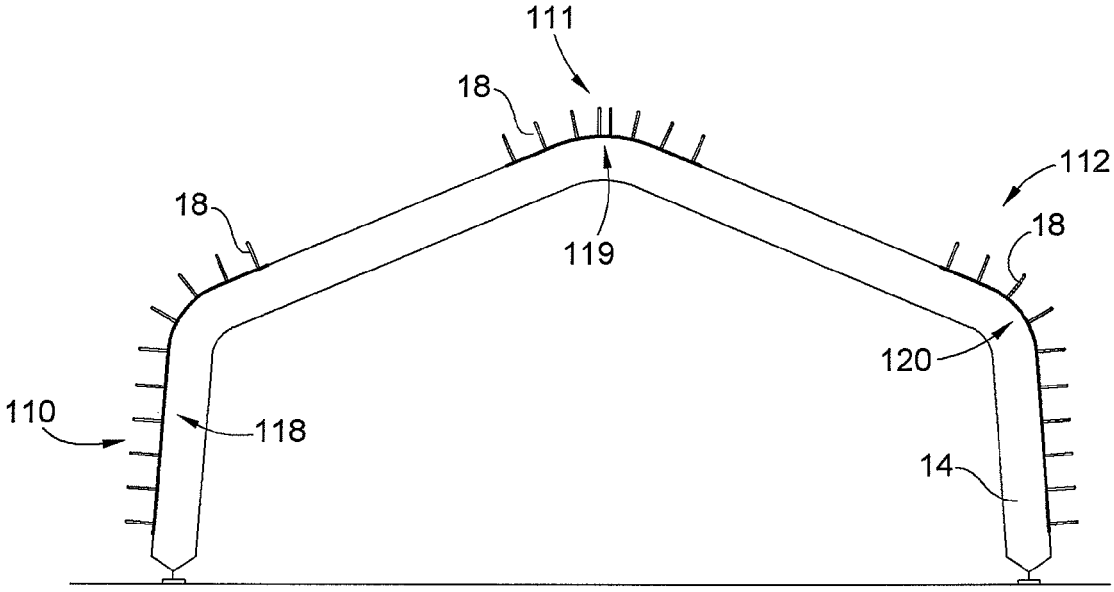
FIG. 5 is front view of an alternative embodiment of an air beam constructed in accordance with the teachings of the present invention.

While it is preferred to use a single length of webbing along the air beam 14, an alternative embodiment of an air beam 14, as illustrated in FIG. 5, can utilize a plurality of laceloop assemblies 110, 111, 112 rather than a single continuous laceloop assembly 10 as in FIG. 1. In such an embodiment, each laceloop assembly 110, 111, 112 includes a plurality of laceloops 18 attached to individual segments of webbing 118, 119, 120. The individual segments of webbing 118, 119, 120 are then secured to the air beam 14.

Figure 6:
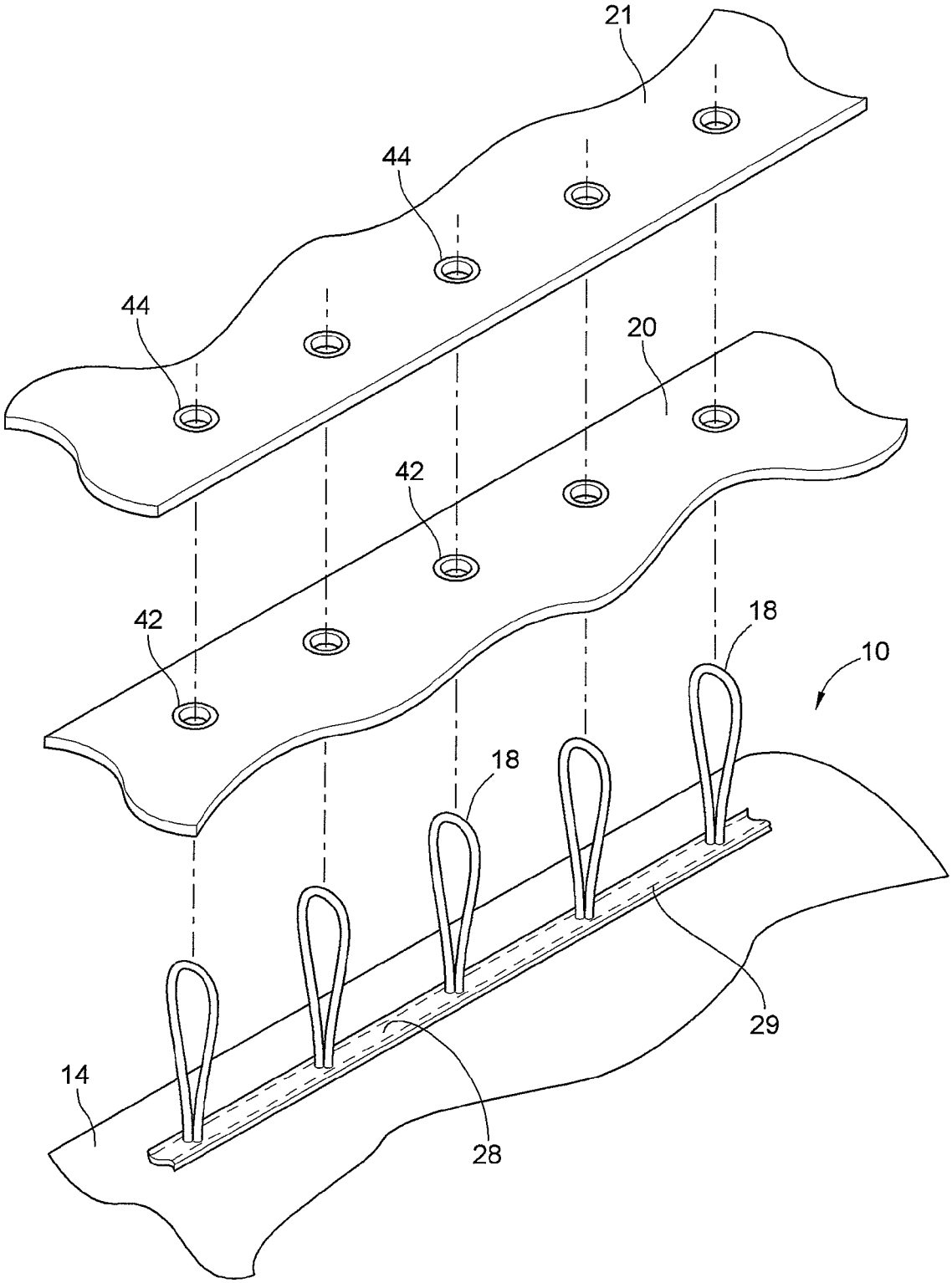
FIG. 6 is a partial exploded illustration of a structure formed using an air beam of FIG. 1 and a plurality of fabric panels.

FIG. 6 illustrates a partial exploded view of two fabric top panels 20, 21 prior to being laced to the air beam 14. Each top panel 20, 21 includes a plurality of grommets 42, 44, respectively. The grommets 42, 44 define apertures through which individual laceloops 18 pass while lacing the top panels 20, 21 to the air beam 14. When assembled, an individual laceloop 18 passes through aligned pairs of grommets 42, 44 of top panels 20, 21, respectively. As such, using the laceloop assembly 10 directly laces the fabric tops 20, 21 to the air beam 14.

Figure 7:
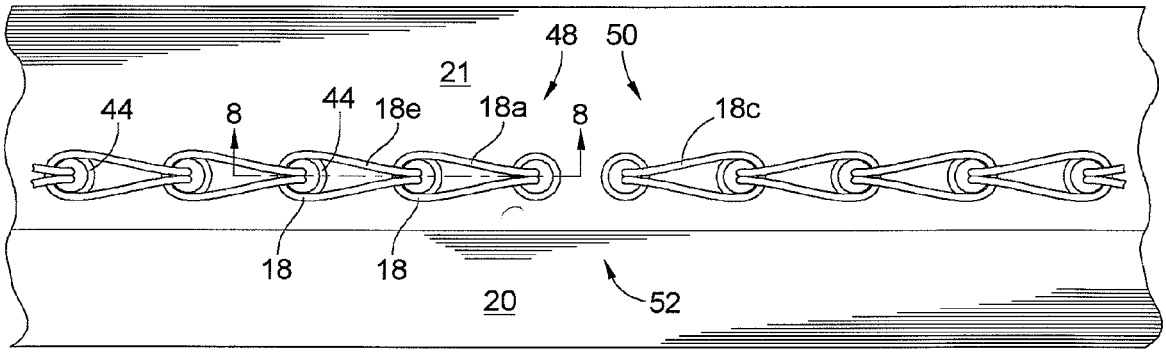
FIG. 7 is a top view of a pair of fabric panels laced to an air beam according to the teachings of the present invention.
Figure 8:
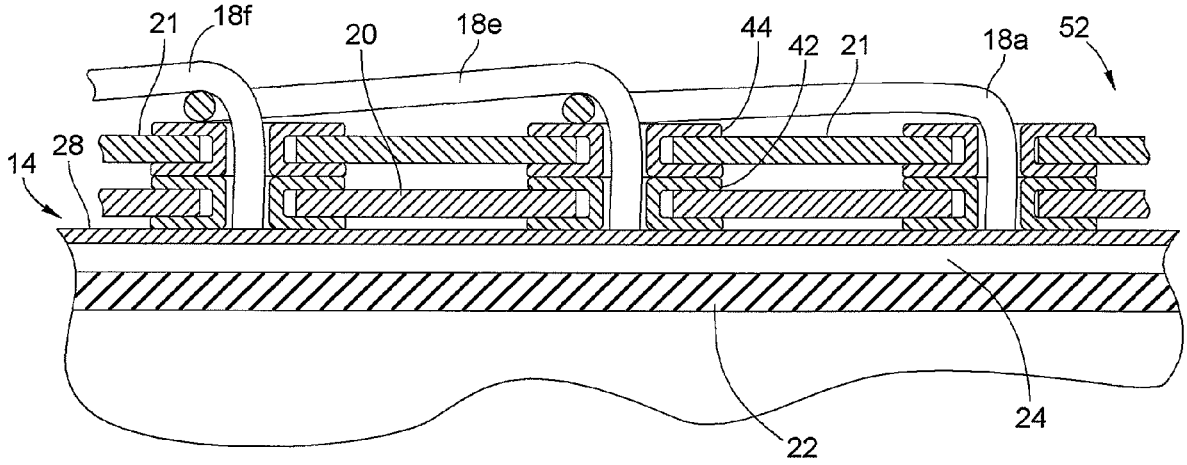
FIG. 8 is a partial cross-sectional illustration of the pair of top panels secured to the air beam of FIG. 7 about line 8-8.

With reference to FIGS. 7 and 8, when assembled, a portion of top panel 21 will overlap a portion of top panel 20. With a laceloop 18 passing through the grommets 42, 44, the apertures defined by the grommets 42, 44 may, at least partially, align. When interlaced, the laceloops 18 will secure the two top panels 20, 21 in the over lapping configuration and to the air beam 14. Typically, all of the laceloops 18 will be passed through the grommets 42, 44 in the top panels 20, 21 prior to beginning lacing adjacent laceloops 18.

Additionally, while the illustrated embodiment of the structure formed according to the teachings of the present invention uses multiple top panels 20, 21, an embodiment of a structure could only use a single panel of material. It should be noted that a single panel of material could be formed from a plurality of pieces of material coupled together prior to being secured to the structural supports according to the teachings of the present invention.

In a preferred method, lacing will include dividing the laceloop assembly 10 into two separate portions 48, 50 of laceloops 18 (see FIG. 2). Typically each portion 48, 50 will include half of the laceloops 18 of the laceloop assembly 10 and will be divided at the peak 52 of the air beam 14. With reference to FIG. 2, the first portion 48 of laceloops 18 includes laceloop 18*a* proximate the peak 52 of the air beam 14, laceloop 18*b* proximate a first end 56 of the laceloop assembly 10 and those laceloops 18 between laceloops 18*a* and 18*b*. The second portion 50 of laceloops 18 includes laceloop 18*c* proximate the peak 52 of the air beam 14, laceloop 18*d* proximate a second end 60 of the laceloop assembly 10 and those laceloops 18 between laceloops 18*c* and 18*d*.

In one method, lacing the laceloops 18 of each portion 48, 50 begins at the peak 52 of the air beam 14 and proceeds outward toward the ends 56, 60 of the laceloop assembly 10. As the lacing process is substantially similar for both the first and second portions 48, 50 of laceloops 18, the lacing process will be primarily described with reference to the first portion 48 of laceloops 18.

Lacing the laceloops 18 can generally be described as passing subsequent free laceloops through the loop of preceding laceloops. With reference to FIGS. 2, 7, 8, 9, the process of lacing begins by passing the second laceloop 18*e* in the string of laceloops, which is a subsequent free laceloop, through the loop formed by the first laceloop 18*a*, which is a preceding laceloop. This step is then repeated with the third laceloop 18*f*, which is the next free subsequent laceloop in the portion 48 of laceloops 18. As such, the third laceloop 18*f*, which is now a subsequent free laceloop, is passed through the loop from by the second laceloop 18*e*, which is now a preceding laceloop and is already interlaced to the first laceloop 18*b*. This procedure is repeated for each remaining laceloop 18 until the last laceloop 18*b* in the portion 48 of laceloops 18 is passed through the second to last laceloop 18*g*. At this point, there are no more subsequent free laceloops to be passed through the loop of last laceloop 18*b*.

Figure 10:
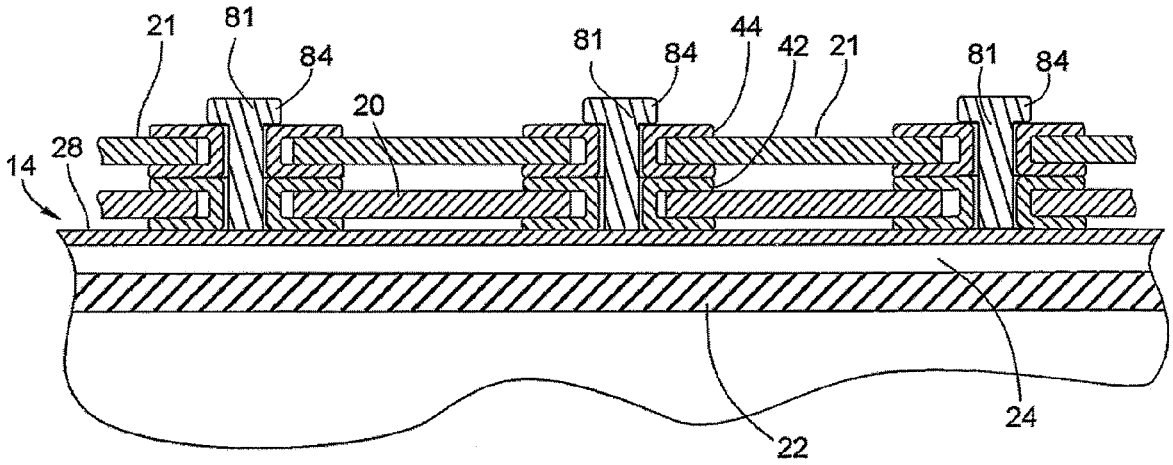
FIG. 10 is a partial cross-sectional illustration similar to that of FIG. 8 illustrating an alternative fastening device in the form of a snap for securing fabric panels to the air beam.

Without any more subsequent free laces to interlace, the last laceloop 18*b* is anchored to prevent the string of interconnected laceloops 18 from unlacing. As illustrated in FIG. 10, the laceloop assembly 10 has been entirely laced and the last laceloop 18*b* has been anchored. Free end 30 of the last laceloops 18*b*, 18*d* wraps directly around stake 70 that are inserted into the ground 72 to anchor the last laceloops 18*b*, 18*d* keeping the last laceloops 18*b*, 18*d* taught and preventing them from being removed from the second to last laceloops 18*g*, 18*h*.

The last laceloop 18*b* can be anchored in any number of ways including, for example, the last laceloop 18*b* could be indirectly secured to a stake by an intermediate strap or rope, the last laceloop 18*b* could be wrapped around the air beam 14, an anchor could be attached to the air beam to which the last laceloop 18*b* is secured, the last laceloop 18*b* could be secured to a heavy object, the last laceloop could be tied back onto itself, etc. In one embodiment, when the last laceloop 18*b* is tied to anchor the string of laceloops, the last laceloop 18*b* is worked back up the string of laceloops 18, for example interwoven or wrapped around the previous laceloops 18 and then tied. The tying may include tying the last laceloop 18*b* back to itself, the rest of the lace line, the air beam 14, the fabric panels 20, 21, etc. When using a tying method to anchor the last laceloop 18*b*, the last laceloop 18*b* may have a length L (see FIG. 3) that extends longer than the other laceloops 18 to facilitate tying and otherwise working the last laceloop 18*b* up the lace line.

During lacing, it is preferred that only a single laceloop 18 passes through the loop of any given laceloop 18. Further, while the method was described as dividing the laceloops 18 into two separate portions 48, 50 and proceeding to lace the laceloops 18 from the peak 52 outward, the method could be practiced by starting at the first end 56 of the laceloop assembly 10 and lacing adjacent laceloops 18 in a direction extending towards the second end 60.

An alternative method according to the present invention could include lacing the two separate portions 48, 50 of laceloops 18 toward one another. As such, the last laceloops would be the two laceloops 18*a*, 18*c* (see FIG. 2) of the respective portions 48, 50, proximate peak 52. Using this method, after lacing the laceloops 18 of the individual portions 48, 50 the two laceloops 18*a*, 18*c* could be directly anchored to one another such as by being tied to one another or clipped to one another to prevent the individual portions 48, 50 from unlacing.

Figure 9:
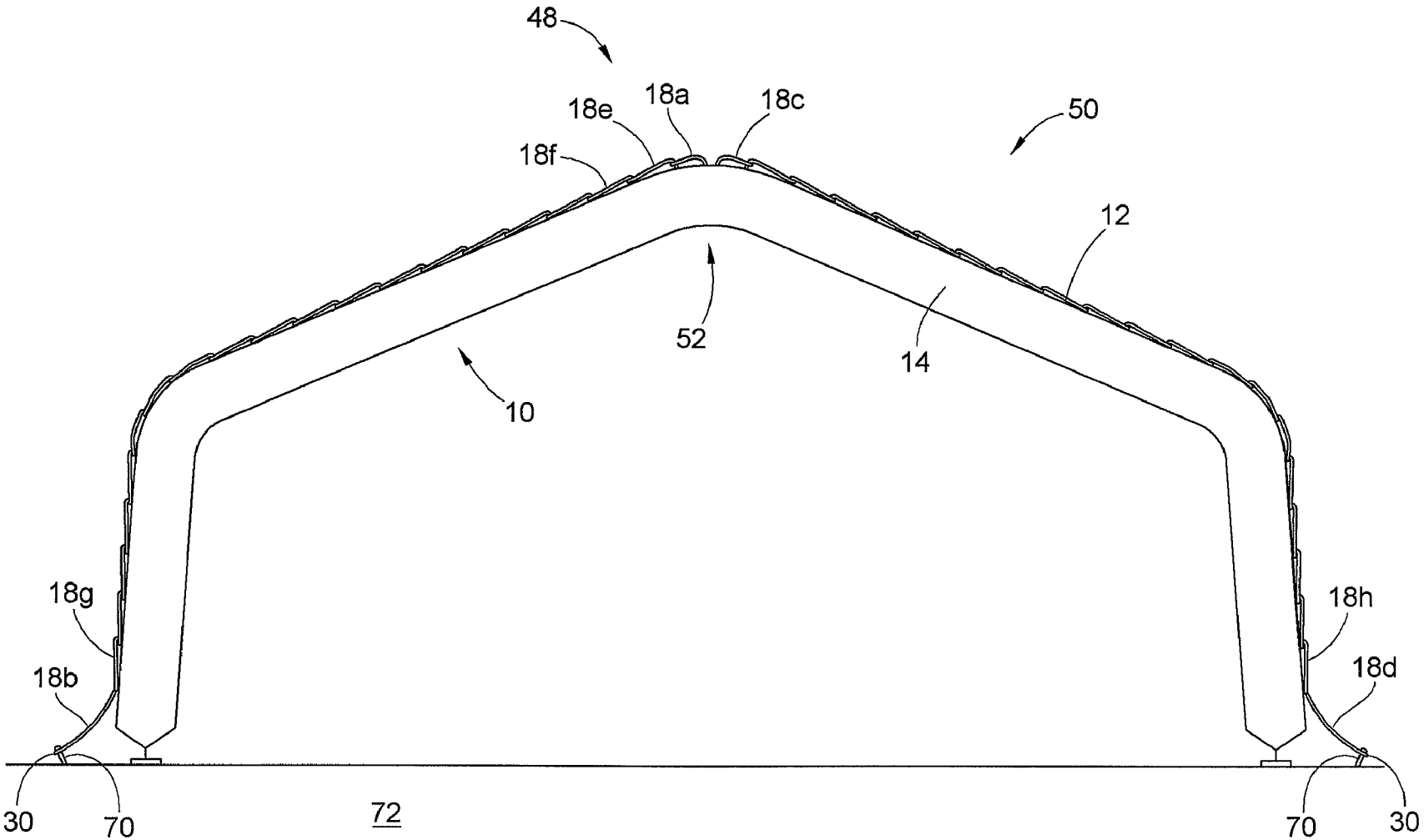
FIG. 9 is a front view of a structure constructed in accordance with the teachings of the present invention, having the top panels completely laced to an air beam of the structure.

After lacing has been completed, the laced laceloops will secure the top panels 20, 21 to the air beam 14. This method and assembly configuration replaces the current method of lacing the top panels 20, 21 together and then attaching the top panels 20, 21 to the air beam 14 with the current web and buckle straps. As discussed above, the problem with the current method is that the web and buckles are spaced too far apart and do not allow the top to stay in a desired position. By using the method and apparatus of the present invention, the top panels 20, 21 will be secured in a more definite position. Additionally, as illustrated in FIG. 9, a load that the top panels 20, 21 place on the air beam 14 in an uplift situation (for example due to wind) will be spread more evenly along the air beam 14 and the top panels 20, 21.

As will be recognized by those skilled in the art in view of the forgoing, the method and apparatus of the present invention is also applicable with other fastening devices other than laceloops 18. With reference to FIG. 10, the fastening devices could include snaps 81 that pass through and engage grommets 42, 44 in the fabric panels 20, 21, respectively. The snaps 81 secure the fabric panels to the air beam 14. The snaps 81 are sized to pass through the grommets 42, 44 but have a flange 84 that extends radially beyond the inner diameter of the grommets 42, 44 of the fabric panels 20, 21. In one embodiment, the flange 84 may resiliently deflect as the snaps 81 are pushed through the grommets 42, 44. Alternatively, the grommets 42, 44 could be oblong and each flange 84 could be similarly oblong shaped and swivel such that after the snap 81 passes through the grommets 42, 44, the snap 81 or flange 84 of the snap can be swiveled or twisted such that the flange 84 overlaps a narrower section of the oblong grommets. This configuration would prevent unnecessary resilient deformation of the snap 81. Additionally, a snap could be in the form of a toggle, such that it can be used with round grommets but still prevent unnecessary resilient deformation. The snaps 81 could be plastic, metal, or any other sufficiently rigid material.

As will be recognized by those skilled in the art in view of the foregoing, the method and apparatus of the present invention is also applicable with other types of supports such as rigid supports, for example, aluminum arches.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An air beam, comprising:

an inflatable bladder; and a plurality of fasteners affixed along a length of the inflatable bladder, wherein the fasteners are laceloops affixed to the inflatable bladder; and wherein the laceloops are attached to an elongated strip of base material forming a laceloop assembly, the laceloop assembly being affixed to the inflatable bladder affixing the laceloops to the inflatable bladder, and wherein the air beam further comprises an outer sleeve surrounding the inflatable bladder, the strip of base material being affixed to the outer sleeve.

2. The air beam of claim 1, wherein each laceloop is formed from an individual lace having opposed ends, the opposed ends being attached proximate one another to the base material to form an enclosed loop.

3. The air beam of claim 1, wherein the strip of base material is chemically bonded to the sleeve.

4. The air beam of claim 1, wherein each laceloop extends a first distance from the base material, the first distance being approximately equal to a second distance being the distance between adjacent laceloops.

5. The air beam of claim 1, wherein the base material is a polyester mesh, the mesh having a width between about 1 inch to 3 inches.

6. The air beam of claim 1, wherein all of the laceloops are formed from a continuous length of laceloop material intermittently secured to the base material.

7. The air beam of claim 1, wherein the elongated strip of base material does not extend more than halfway around the inflatable bladder.

8. A shelter, comprising:

at least one structural support member having a plurality of fasteners affixed thereto;

at least one fabric panel; and wherein the fasteners secure the at least one fabric panel to the structural support member in a plurality of locations along a length of the at least one structural member and wherein the fasteners are a plurality of laceloops; and wherein the plurality of the laceloops includes at least one last laceloop and each laceloop except for the at least one last laceloop receives a single adjacent one of the laceloops through the loop formed by the laceloop.

9. The shelter of claim 8, wherein the structural support member is a rigid structural support member.

10. The shelter of claim 8, wherein the plurality of laceloops are formed in a laceloop assembly, the laceloop assembly including a base material in the form of webbing, the plurality of laceloops secured to the base material.

11. The shelter of claim 10, wherein the at least one structural support member includes a plurality of inflatable air beams, each air beam having a laceloop assembly.

12. The shelter of claim 11, wherein the at least one fabric panel includes a plurality of fabric panels and wherein adjacent fabric panels overlap one another proximate one of the structural support members, the laceloop assembly of the proximate structural support member securing both fabric panels to the structural support member.

13. The shelter of claim 12, wherein the plurality of fabric panels include a plurality of apertures, wherein each aperture of a first overlapping portion of a first fabric panel aligns with a corresponding aperture of a second overlapping portion of a second fabric panel, each set of aligned apertures receives a corresponding laceloop therethrough.

14. The shelter of claim 8, wherein each laceloop extends a first distance from the base material, the first distance being approximately equal to a second distance being the distance between adjacent laceloops.

15. A method of constructing a shelter, comprising the step of lacing a first fabric panel to a structural support member to form the shelter;

wherein the step of lacing includes passing at least one laceloop through the first fabric panel; and wherein the step of lacing includes passing a plurality of laceloops through the first panel and interconnecting a first string of the laceloops by passing a subsequent laceloop in the first string of laceloops through a preceding laceloop of the first string of laceloops until all of the laceloops in the first string of laceloops are interconnected, wherein no more than one laceloop is passed through any given laceloop.

16. The method of claim 15, wherein the step of lacing further includes overlapping a second portion of a second fabric panel over a first portion of the first panel and passing the plurality of laceloops through the overlapping portions of the first and second panels.

17. The method of claim 15, further comprising the step of anchoring a last laceloop in the string of laceloops to prevent the string of laceloops from unlacing.

18. The method of claim 17, wherein anchoring includes working the laceloop back up the string of laceloops and tying-off the last laceloop.

19. The method of claim 15, wherein the step of lacing includes interconnecting a second string of laceloops by passing a subsequent laceloop in the second string of laceloops through a preceding laceloop of the second string of laceloops until all of the laceloops in the second string of laceloops are interconnected, wherein no more than one laceloop is passed through any given laceloop.

20. The method of claim 19, wherein the first and second strings of laceloops are formed by a single laceloop assembly and the first string includes a first portion of laceloops of the laceloop assembly and the second string includes a second portion of laceloops of the laceloop assembly, and wherein each string of laceloops is laced in a direction extending away from the other string of laceloops and towards an end of the laceloop assembly.

21. The method of claim 19, wherein the first and second strings of laceloops are formed by a single laceloop assembly and the first string includes a first half of laceloops of the laceloop assembly and the second string includes a second half of laceloops of the laceloop assembly, and wherein each string of laceloops is laced in a direction extending toward the other string of laceloops, further comprising anchoring the last laceloop of the first and second strings to one another.

22. The method of claim 15, wherein passing a plurality of laceloops through the first panel comprises passing a plurality of laceloops through the first panel, wherein each of the plurality of laceloops extends a first distance from the base material, the first distance being approximately equal to a second distance being the distance between adjacent laceloops.

* * * * *